US008950515B2

(12) United States Patent
Schroder

(10) Patent No.: US 8,950,515 B2
(45) **Date of Patent: *Feb. 10, 2015**

(54) CONE RETENTION AND TAPERED BEARING PRELOAD SYSTEM FOR ROLLER CONE BIT

(75) Inventor: Jon D. Schroder, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 617 days.

This patent is subject to a terminal disclaimer.

(21) Appl. No.: 13/287,792

(22) Filed: Nov. 2, 2011

(65) Prior Publication Data

US 2013/0105229 A1 May 2, 2013

(51) Int. Cl.
*E21B 10/22* (2006.01)

(52) U.S. Cl.
CPC ..... *E21B 10/22* (2013.01)
USPC ..... 175/371; 175/359; 384/93; 384/96

(58) Field of Classification Search
CPC ..... E21B 10/22–10/24; F16C 2352/00; F16C 33/6659
USPC ..... 175/337, 359, 371; 384/92, 93, 96, 462
See application file for complete search history.

(56) References Cited

U.S. PATENT DOCUMENTS

| | | | | |
|---|---|---|---|---|
| 2,038,388 | A | 4/1936 | Sherman | |
| 2,058,155 | A * | 10/1936 | Howard et al. | 175/332 |
| 2,111,732 | A * | 3/1938 | Reed | 384/96 |
| 2,490,151 | A | 12/1949 | Nobel et al. | |
| 2,579,819 | A * | 12/1951 | Green | 384/96 |
| 3,193,025 | A | 7/1965 | Reitzel | |
| 3,476,195 | A * | 11/1969 | Galle | 175/228 |
| 3,658,141 | A * | 4/1972 | Schumacher, Jr. | 175/364 |
| 3,998,500 | A * | 12/1976 | Dixon | 384/96 |
| 4,802,539 | A * | 2/1989 | Hall et al. | 175/371 |
| 2009/0173546 | A1 | 7/2009 | Peterson et al. | |

* cited by examiner

*Primary Examiner* — Jennifer H Gay
*Assistant Examiner* — Steven MacDonald
(74) *Attorney, Agent, or Firm* — Steve Rosenblatt

(57) ABSTRACT

The roller cone is retained to the head with axial play taken out of the bearings with a tension rod tensioned from the rear of the head and away from the nose bearing region of the head allowing greater resistance to loading in the region of the nose bearing and a reduction in critical stresses. The tension rod has a flat oriented for tightening and facing grease passages to allow grease to gain access to the bearings through the bore for the tension rod and otherwise fill the bore so the tension rod actively supports loading in the head bearing. The nose bearing is separately directly cone supported with a retainer threaded to the cone or a spacer between bearings can be used so that tensioning of the rod takes out the axial play in both bearings with force transmitted to a retainer at the back of the cone.

10 Claims, 3 Drawing Sheets

CONE RETENTION AND TAPERED BEARING PRELOAD SYSTEM FOR ROLLER CONE BIT

FIELD OF THE INVENTION

The field of the invention is roller cone rock bits and more particularly a retention system for the cone that allows control of axial play and more particularly employing the use of tapered roller bearings and components that facilitate bearing support and lubricant distribution.

BACKGROUND OF THE INVENTION

Roller cone bits have typically used roller bearings and have employed a variety of connection methods for the cone to the bit body. U.S. Pat. No. 2,038,388 used a pin 19 that turned on bearings 18 with the cone 1. A set screw into the pin 19 through the cone 1 ensured that the pin and cone would turn together. The bearings 18 get preloaded but not the roller bearings between the head and the cone. U.S. Pat. No. 2,490,151 shows a tension rod mounted to cone, then welded to the head. It retains the cone but does not use rollers, eliminate axial play, communicate grease, or load the bearing assembly. It also acts as a thrust pin. U.S. Pat. No. 3,193,025 uses threads in the nose of the head bearing to lock down a flanged head and load the opposed tapered rollers. In US Publication 2009/0173546 the entire head bearing is independent of the head section itself, and is used as both the male journal as well as the pre-loading mechanism. There is no provision for grease compensation.

What is needed is a way of taking out axial play from bearings on a roller cone while still providing for a sufficiently strong support structure adjacent the nose bearing to withstand the loads encountered during drilling or reaming. The present invention applies tension to a tension rod in the head at a remote location from the head end where the cone nose bearing is supported. Grease passages are provided from a fill location in the rear of the head through the bore for the tension rod and on the way to the cone bearings. The rod is provided with a flat to minimize material removal as an aid to resisting bending stresses through the cone and to allow a more sturdy support for the bearing assembly. An alignment feature is provided to allow the flat to be oriented to the grease passages and to allow torque to be applied to a torque nut whose position is then maintained with welding. The nose bearing can be supported from a retainer nut threaded into the cone such that tension in the rod will remove the axial play on the nose bearing against the retainer nut and further tension will bring the head and cone closer to remove axial play on the main bearing. Alternatively a spacer between the bearings will remove axial play in the main bearing as force is transferred from the nose bearing into the spacer and into the main bearing through the spacer. These and other features of the present invention will be more readily apparent to those skilled in the art from a review of the detailed description and the associated drawings while recognizing that the full scope of the invention is to be determined by the appended claims.

SUMMARY OF THE INVENTION

The roller cone is retained to the head with axial play taken out of the bearings with a tension rod that is tensioned from the rear of the head and away from the nose bearing region of the head allowing greater resistance to loading in the region of the nose bearing and a reduction in critical stresses. The tension rod has a flat and is oriented for tightening so that the flat faces grease passages to allow grease to gain access to the bearings through the bore for the tension rod and otherwise fill the bore so the tension rod actively supports loading in the head bearing. The nose bearing can be separately supported to the cone directly with a retainer threaded to the cone or a spacer between the bearings can be used so that tensioning of the rod takes out the axial play in both bearings with force transmitted to a retainer at the back of the cone.

DETAILED DESCRIPTION OF THE PREFERRED EMBODIMENT

Figure 1:
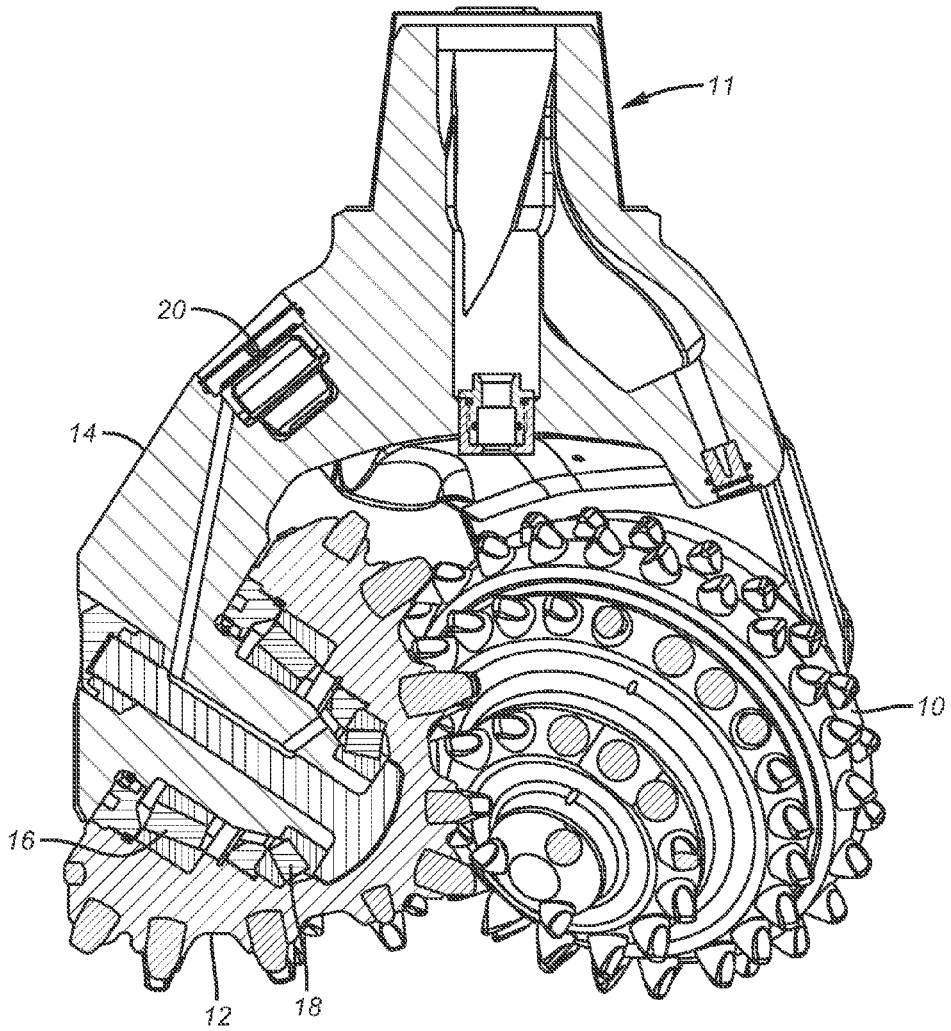
FIG. 1 is a part section view of a roller cone bit showing the various features of the invention in the section view.

FIG. 1 illustrates two roller cones 10 and 12 attached to a respective head 14 that is an offshoot of the body 11 with cone 12 cut away to show some of the details of the invention. A main bearing 16 and a nose bearing 18 are disposed between the head 14 and each cone such as 10 and 12. Those skilled in the art will appreciate that a typical roller cone bit has three roller cones and only two are illustrated so that internal details can be shown. The invention encompasses bits that have one or more roller cones and includes hybrid bits that may have a single or multiple roller cones as well as traditional roller cone bits with multiple cones. While the main bearing 16 and the nose bearing 18 are schematically illustrated as tapered roller bearings those skilled in the art will appreciate that the bearing style can change depending on the anticipated loading. In the larger sizes such as 24 inches it is anticipated that the tapered roller bearings will be used as shown. However, for other sizes cylindrical rollers combined with thrust bearings having opposed hardened surfaces can also be used with this invention.

A pressure compensation system 20 permits the loading of grease that passes through passage 22 into the tension rod bore 24. Tension rod 26 has a flat 28 on shaft 30 to create a passage 32 in bore 24 that leads to passage 34 that extends to the location between the bearings 16 and 18. Tension rod 26 has a cap 36 that fits in a cavity 38 in the cone 12. If the cap 36 and the cavity 38 are shaped for relative rotation an orientation pin 40 in the cap 36 can extend into a blind bore 42 in the head 14 so that relative rotation between the cap 36 and the head 14 will be prevented. The location of the pin and blind bore can be reversed to get the same effect. Alternatively the cap 36 and the cavity 38 can be shaped so that a single orientation is possible for makeup that coincidentally aligns the flat 28 to allow grease to flow between passages 22 and 34.

Bearing 18 has an inner race 44, tapered rollers 46 and an outer race 48. A retainer 50 is threaded at 52 to the cone 12 and the threaded position is retained with retaining ring 54. Cap 36 has a clearance to the end of the cone 12 while bearing down on the inner race 44 with clearance remaining to head 14.

Figure 2:
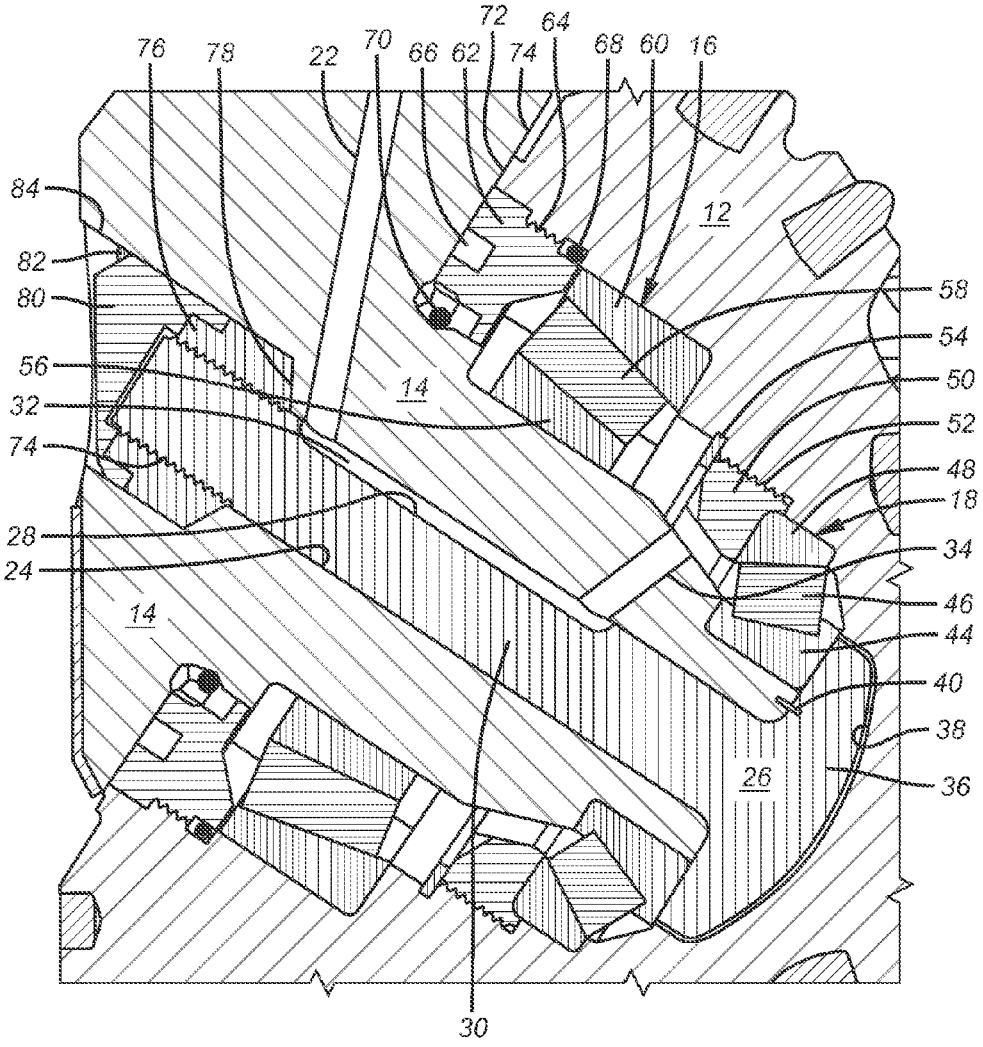
FIG. 2 is a detailed view of the section view in FIG. 1 to allow additional details to be seen.

Bearing 16 has an inner race 56, tapered rollers 58 and an outer race 60. A retainer 62 is secured at thread 64 using a tool inserted into depressions 66. The retainer 62 holds in place an o-ring seal 68 on the outside and a metal to metal loaded seal assembly 70 on the inside. In FIG. 1 and FIG. 2 retainer 62 does not retain the main bearing assembly. The cone 12 has a raised surface 72 around the retainer 62 to create a gap 74 to allow some flexing under load of the cone 12 without contact of the head 14 and to promote debris evacuation.

Shaft 30 has thread 74 located near the opposite end from the cap 36. A nut 76 is formed to mate at a leading end to a taper 78 in the head 14. Nut 76 can have a hex top end that is 6 or 12 point or some other feature for engaging nut 76 with a tool to turn it and make up the thread 74 to put tension into the tension rod 26. A cap 80 that has a lower end that conforms to the top of the nut 76 is put onto the nut 76 after tensioning and welded at 82 in bore.

Tightening the nut 76 makes cap 36 push on inner race 44 without contacting the head 14. That force transfers to the rollers 46 and then to outer race 48 and then into the cone 12 through the retainer 50. Further tightening then pulls the head 14 toward the cone 12 to exert a force on the inner race 56 that is transferred to the outer race 60 through rollers 58. The cone 12 has a shoulder that backstops the outer race 60 and the axial play is removed from bearings 16 and 18.

Figure 3:
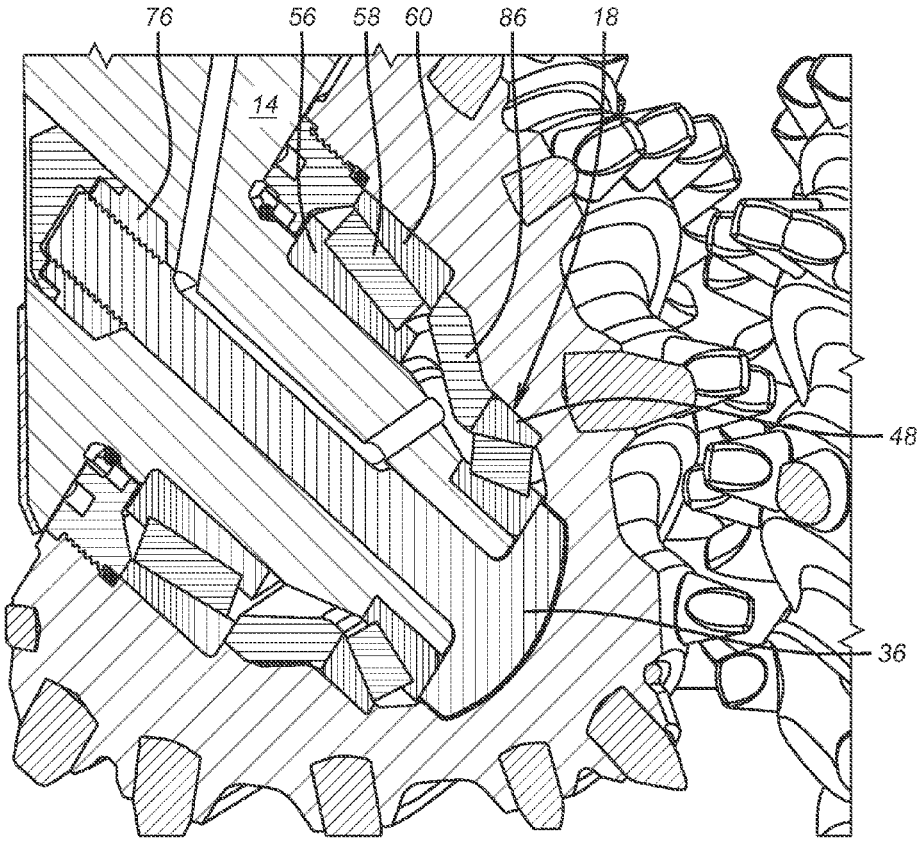
FIG. 3 is an alternative embodiment of FIG. 2 showing a spacer extending between the bearings.

FIG. 3 is similar to FIG. 2 except when the nut 76 is tightened the force from cap 36 goes through the nose bearing 18 as described before but now the outer race 48 loads the spacer 86 which then loads the outer race 60 and the load then goes through rollers 58 to inner race 56 that is shouldered out on the head 14. Outer race 60 is retained in the cone through retainer 62' whose function is somewhat different in FIG. 3 than retainer 62 in FIG. 2.

The exterior of the roller cones is not discussed as the cutting structure is known in the art. The same is true for the passages in the head that lead to the nozzles some of which are shown in FIG. 1.

By locating the threads 74 on the opposite side of the tension rod 26 from the cap 36 the support for the nose bearing 18 is enhanced as compared to prior designs that put a thread in that location near the cap. A thread that is cut into a loaded region of the head 14 weakens it by removing metal. As a result there is a greater stress concentration under the nose bearing as opposed to application of a tensioning force remotely with nut 76 leaving no threads in head 14. Shaft 30 fills bore 24 in the region within the bearing 18 for greater resistance to bending moments. The use of flat 28 rather than a circular groove additionally strengthens head 14 against bending moments while drilling by filling bore 24. Alignment features on the rod 26 ensure that the flat 28 will be properly oriented to allow grease communication between passages 22 and 34. The bearings 16 and 18 can transmit load directly through a spacer 86 shown in FIG. 3 or with a separate retainer 50 supporting bearing 18 that allows rotation of nut 76 to first take out axial play on bearing 18 and then take out the axial play on bearing 16 from the opposite direction.

While the discussion above has focused on a single mounting of a cone those skilled in the art will appreciate that when there are multiple cones the same discussion applies to each cone. While bearings 16 and 18 are shown with tapered rollers that are preferred for larger sized bits, those skilled in the art will recognize that the depiction of tapered roller bearings is intended to be schematic for other bearing types that can be used notably for smaller bit sizes with cylindrical and thrust bearings.

The above description is illustrative of the preferred embodiment and many modifications may be made by those skilled in the art without departing from the invention whose scope is to be determined from the literal and equivalent scope of the claims below.

I claim:

1. A bit for subterranean use, comprising:

a body comprising at least one head;

at least one cone mounted to a corresponding head through a bore in said head with a retaining member extending in said bore, said cone comprising a plurality of roller bearings between said cone and an outer surface of said head and said roller bearings spaced apart from each other in a direction defined by a longitudinal axis of said retaining member;

said retaining member contacting at least one said bearing for removal of axial play in said plurality of bearings in response to a mechanism for application of tension to said retaining member located remotely from the direct contact location of said retaining member to said at least one bearing within said cone, said retaining member pushing said bearings together against a stop in said cone when removing axial play.

2. The bit of claim 1, wherein:

said retaining member comprises a cap adjacent a cone end thereof and said mechanism is located adjacent an opposite end from said cap.

3. A bit for subterranean use, comprising:

a body comprising at least one head;

at least one cone mounted to a corresponding head through a bore in said head with a retaining member extending in said bore, said cone comprising a plurality of roller bearings between said cone and an outer surface of said head;

said retaining member contacting at least one said bearing for removal of axial play in said plurality of bearings in response to a mechanism for application of tension to said retaining member located remotely from the direct contact location of said retaining member to said at least one bearing within said cone, said retaining member pushing said bearings together against a stop in said cone when removing axial play;

said retaining member comprises a cap adjacent a cone end thereof and said mechanism is located adjacent an opposite end from said cap;

said retaining member comprises a shaft extending in said bore from said cap to said mechanism;

said bearings comprise a main bearing and a nose bearing, said cap contacting said nose bearing.

4. The bit of claim 3, wherein:

said mechanism comprises a thread on said shaft located in an enlarged segment of said bore defined by a bore transition in said head and a nut to draw tension on said shaft when rotated into contact with said transition.

5. The bit of claim 3, wherein:

said main and nose bearings comprise tapered bearings that are in direct contact with a spacer mounted in between.

6. The bit of claim 3, wherein:

said shaft further comprises a flat;

said head comprises grease passages that communicate through a passage in said bore defined by said flat.

7. The bit of claim 6, wherein:

said cap comprises an alignment feature for orientation of said flat adjacent said grease passages.

8. The bit of claim 7, wherein:

said alignment feature comprises a pin in one of said cap and said head and a blind bore in the other of said cap and said head.

9. The bit of claim 7, wherein:

said alignment feature comprises a conforming shape in said cone for said cap that permits a unique flat orientation with respect to said grease passages.

10. A bit for subterranean use, comprising:

a body comprising at least one head;

at least one cone mounted to a corresponding head through a bore in said head with a retaining member extending in said bore, said cone comprising a plurality of bearings between said cone and an outer surface of said head;

said retaining member contacting at least one said bearing for removal of axial play in response to a mechanism for application of tension to said retaining member located remotely from the contact location of said retaining member to said at least one bearing;

said retaining member comprises a cap adjacent a cone end thereof and said mechanism is located adjacent an opposite end from said cap;

said retaining member comprises a shaft extending in said bore from said cap to said mechanism;

said at least one bearing comprises a main bearing and a nose bearing, said cap contacting said nose bearing;

said mechanism comprises a thread on said shaft located in an enlarged segment of said bore defined by a bore transition in said head and a nut to draw tension on said shaft when rotated into contact with said transition;

said mechanism further comprises a mechanism cap that conforms to the shape of said nut to fixate the position of said nut after tension is applied by securing said mechanism cap in said enlarged segment of said bore.

* * * * *